US007442110B2

(12) United States Patent
Gaudet et al.

(10) Patent No.: US 7,442,110 B2
(45) Date of Patent: Oct. 28, 2008

(54) BRASSIERE, BRASSIERE COMPONENTS, AND MATERIALS FOR USE THEREOF

(75) Inventors: Jeanine Gaudet, Dracut, MA (US); Nancy DaSilva-Castro, Sassonet, MA (US)

(73) Assignee: Saucony Inc., Lexington, MA (US)

( * ) Notice: Subject to any disclaimer, the term of this patent is extended or adjusted under 35 U.S.C. 154(b) by 551 days.

(21) Appl. No.: 10/847,637

(22) Filed: May 17, 2004
(Under 37 CFR 1.47)

(65) Prior Publication Data

US 2005/0255789 A1 Nov. 17, 2005

(51) Int. Cl.
*A41C 3/00* (2006.01)
*A41C 3/10* (2006.01)

(52) U.S. Cl. ..... 450/39; 450/57

(58) Field of Classification Search ..... 450/39, 450/36, 37, 38, 54–58; 623/7, 8; 2/267, 2/268, 467, 24, 92
See application file for complete search history.

(56) References Cited

U.S. PATENT DOCUMENTS

| | | | | |
|---|---|---|---|---|
| 532,756 | A | 1/1895 | Bergheim | |
| 810,332 | A | 1/1906 | Grean | |
| 2,068,644 | A | 1/1937 | Frais | |
| 2,437,054 | A | 3/1948 | Tatai | |
| 2,445,767 | A | 7/1948 | Dickerson | |
| 2,482,255 | A | 9/1949 | Florsheim, Jr. | |
| 2,579,365 | A * | 12/1951 | Conde | 450/39 |
| 2,616,093 | A | 11/1952 | Talalay | |
| 2,659,085 | A * | 11/1953 | Ericson | 450/39 |
| 2,727,278 | A * | 12/1955 | Thompson | 264/46.4 |
| 2,748,771 | A | 6/1956 | Richards | |
| 2,793,369 | A * | 5/1957 | Panighini | 450/53 |
| 2,797,415 | A * | 7/1957 | Spanel et al. | 450/39 |
| 2,864,373 | A | 12/1958 | Buckley | |
| 3,021,844 | A | 2/1962 | Flagg et al. | |
| 3,021,845 | A * | 2/1962 | Smith | 450/39 |
| 3,176,686 | A | 4/1965 | Barnes | |
| 3,266,495 | A * | 8/1966 | Sachs | 450/55 |
| 4,080,416 | A * | 3/1978 | Howard | 264/258 |

(Continued)

OTHER PUBLICATIONS

Product listing for "Cameo Bra" downloaded from www.title9sports.com on Jan. 22, 2004, p. 1.

(Continued)

*Primary Examiner*—Gloria Hale
(74) *Attorney, Agent, or Firm*—Wolf, Greenfield & Sacks, P.C.

(57) ABSTRACT

A breathable and moisture permeable bra that is stylish, provides adequate support and is comfortable to wear is provided. Materials, such as wicking materials, for use in the bra, as well as other active wear, are also provided. The brassiere may include breast-supporting pads having a pad component including a perforated, molded foam cup encased by an inner and a first outer cloth layers and a second outer cloth attached to the outside of the pad component. The cloths may include materials that are breathable and may have wicking properties. In addition to the pad, the brassiere may include a wicking layer adapted to lie adjacent a wearer's skin to pull moisture away from the skin. The brassiere may also include an outer layer adapted to lie most distal the user's skin, that may provide an aesthetically pleasing exterior of the brassiere.

97 Claims, 11 Drawing Sheets

U.S. PATENT DOCUMENTS

| | | | | | |
|---|---|---|---|---|---|
| 4,091,819 | A | * | 5/1978 | Huber et al. | 450/55 |
| 4,458,684 | A | | 7/1984 | Frankel | |
| 5,032,103 | A | | 7/1991 | Larsson | |
| 5,244,432 | A | | 9/1993 | Moy Au et al. | |
| 5,269,720 | A | | 12/1993 | Moretz et al. | |
| 5,361,410 | A | | 11/1994 | Sigl | |
| 5,385,502 | A | | 1/1995 | Moretz et al. | |
| 5,441,436 | A | | 8/1995 | Moretz et al. | |
| 5,492,501 | A | * | 2/1996 | Brown | 450/31 |
| 5,522,892 | A | * | 6/1996 | Lin | 623/7 |
| 5,806,103 | A | | 9/1998 | McCracken et al. | |
| 6,110,006 | A | | 8/2000 | Chen | |
| 6,213,841 | B1 | | 4/2001 | Kuo | |
| 6,283,820 | B1 | | 9/2001 | Huang | |
| 6,299,505 | B1 | | 10/2001 | Huang | |
| 6,306,006 | B1 | * | 10/2001 | Cheng | 450/57 |
| 6,398,620 | B1 | | 6/2002 | Huang | |
| 6,406,351 | B1 | | 6/2002 | Chen | |
| 6,406,352 | B1 | | 6/2002 | Cheng | |
| 6,425,800 | B1 | | 7/2002 | Huang | |
| 6,540,585 | B1 | * | 4/2003 | Lee | 450/38 |
| 6,811,463 | B2 | * | 11/2004 | Martz | 450/57 |
| 2002/0022433 | A1 | | 2/2002 | Yeung et al. | |
| 2003/0027492 | A1 | | 2/2003 | Roffidal | |

OTHER PUBLICATIONS

Product listing for "Sydney T-Back" downloaded from www.movingcomfort.com on Jan. 22, 2004, p. 1.

Sorbtek specification sheet downloaded from www.sorbtek.com on Feb. 17, 2004, p. 1.

Title Nine Sports® Catalog, Spring 2004.

* cited by examiner

| ref. | Measurement Point | How to Measure | 32B | 32C | 34B |
|---|---|---|---|---|---|
| A | Bottom Band Relaxed Circumference | Measure flat across bottom opening edge (including hook & 1st eye) | −1 | −1 | Standard |
| B | Front Neckline Height | Measure from Shoulder seam to Center Front along neck edge | −1/4 | 0 | Standard |
| C | Front Armhole Height | Measure from Shoulder seam to side seam along armhole edge | −1/4 | 0 | Standard |
| D | Center Front Length | Measure Length from CF neck to finished bottom opening | −1/8 | 0 | Standard |
| E | Back Neckline/ Strap Height | Measure from shoulder seam to CB along edge excluding hook & eye | −1/4 | 0 | Standard |
| F | Side Seam Length | Measure from underarm to bottom opening | −1/8 | 0 | Standard |
| G | Cup base Length (No Wire) | Measure along bottom cup channel along outside edge | −5/8 | 0 | Standard |
| H | Back Armhole Height | Measure from shoulder seam to side seam along armhole edge | −1/2 | −7/8 | Standard |
| I | Hook and Eye Tape Height | Measure from top of tape to bottom of tape length | 0 | 0 | Standard |
| J | Strap Width at Shoulder | Measure finished edge to edge at shoulder | 0 | 0 | Standard |
| K | Bust Circumference | Measure flat across over bust molded cups from under arm to underarm with bra fastened to 1st hook & eye | −1 | −1 | Standard |
| L | Front Body Width at Bottom band | Measure along bottom band opening from side seam to side seam | −1/2 | +1/2 | Standard |
| M | Back Wing Body Width at Bottom band | Measure along bottom wing band opening from side seam to 1st hook & eye closure | −1/4 | −3/4 | Standard |

A

B

FIG. 8A(1) FIG. 8A(2) FIG. 8A(1)

| 34C | 34D | 34DD | 36B | 36C | 36D | 38B | 38C | Tolerance |
|---|---|---|---|---|---|---|---|---|
| 0 | 0 | 0 | +2 | +2 | +2 | +4 | +4 | 3/4" |
| +1/4 | +1/2 | +3/4 | +1/4 | +1/2 | +3/4 | +1/2 | +3/4 | 1/4" |
| +1/4 | +1/2 | +3/4 | +1/4 | +1/2 | +3/4 | +1/2 | +3/4 | 1/4" |
| +1/8 | +1/4 | +3/8 | +1/8 | +1/4 | +3/8 | +1/4 | +3/8 | 1/4" |
| +1/4 | +1/2 | +3/4 | +1/4 | +1/2 | +3/4 | +1/2 | +3/4 | 1/4" |
| +1/8 | +1/4 | +3/8 | +1/8 | +1/4 | +3/8 | +1/4 | +3/8 | 1/4" |
| +5/8 | +1 1/4 | +1 7/8 | +5/8 | +1 1/4 | +1 7/8 | +1 1/4 | +1 7/8 | 1/4" |
| −3/8 | −3/4 | −1 1/8 | +1/2 | +1/8 | −1/4 | +1 | +5/8 | 1/4" |
| 0 | +3/8 | +3/8 | 0 | +3/8 | +3/8 | +3/8 | +3/8 | 0 |
| 0 | +1/8 | +1/8 | 0 | +1/8 | +1/8 | +1/8 | +1/8 | 1/8" |
| 0 | 0 | 0 | +2 | +2 | +2 | +4 | +4 | 3/4" |
| +1 | +2 | +3 | +1 | +2 | +3 | +2 | +3 | 1/4" |
| −1/2 | −1 | −1 1/2 | +1/2 | 0 | −1/2 | +1 | +1/2 | 1/4" |

FIG. 8A(2)

BRASSIERE, BRASSIERE COMPONENTS, AND MATERIALS FOR USE THEREOF

FIELD OF THE INVENTION

The invention relates to brassieres, brassiere components, and materials for use thereof, with one or more improved characteristics, such as, for example appearance, comfort, support and moisture management.

BACKGROUND OF THE INVENTION

Clothing manufacturers have been challenged in meeting the often competing demands of designing a fashionable article of clothing and providing one that adequately performs under desired conditions. For example, with active wear, the article of clothing must provide adequate support and moisture management while being pleasing to the eye and comfortable to wear.

One particular article of active wear that has suffered in this regard is sports bras. Moisture perspiration tends to accumulate in an area beneath and/or between the breasts, resulting in an uncomfortable feeling, and in severe cases resulting in odors, rashes, chafing, bacteria and fungus growth and infections. Clearly, as with any article of active wear, moisture management for sports bras is an important consideration.

Support is also an important consideration. Sports bras with good moisture management characteristics tend to be more comfortable to wear, but they lack adequate support for the user during, for example, physical exercise. Bras with support structures such as relatively stiff fabrics and/or construction work well to provide the necessary support, but they may impede the desired moisture management and may be uncomfortable to wear. Additionally, bras that seemingly strike a balance between support, moisture management and comfort are not as stylish as some women would prefer.

SUMMARY OF THE INVENTION

The invention presents a novel, multi-layer brassiere and components thereof with one or more improved characteristics, such as, for example, appearance comfort, support and moisture management capabilities. The brassiere covers and supports the wearer's breasts while being breathable and allowing moisture to permeate the materials. The brassiere may include breast-supporting pads having a pad component including a perforated cup attached to an inner and a first outer cloth layers and a second outer cloth attached to the outside of the pad component. The pad may be formed as a molded foam cup to more closely conform to the wearer's contours. The cloths may include materials that are breathable and may have wicking properties. In addition to the pad, the brassiere may include a wicking layer adapted to lie adjacent a wearer's skin to pull moisture away from the skin at and/or adjacent the breasts. The brassiere may also include an outer layer adapted to lie most distal the user's skin that may provide an aesthetically pleasing exterior of the brassiere.

According to one aspect, the invention is a breast pad constructed and arranged to be used in a brassiere. The pad may include a pad component which may include a foam layer including an outer surface, an inner surface and a plurality of openings that extends from the inner surface to the outer surface, an inner cloth attached to at least a substantial portion of the inner surface of the foam layer, and a first outer cloth attached to at least a substantial portion of the outer surface of the foam layer. The pad may also include a second outer cloth attached to at least a portion of the pad component and adjacent the first outer cloth.

According to another aspect, the invention is a brassiere for covering at least a portion of the breasts of a wearer. A cross-section of at least a portion of the brassiere may include a first layer, a second layer constructed and arranged to lie more distal the wearer than the first layer, a third layer constructed and arranged to lie more distal the wearer than the second layer, a fourth layer constructed and arranged to lie more distal the wearer than the third layer and a fifth layer constructed and arranged to lie more distal the wearer than the fourth layer. The first layer may include an inner cloth that is constructed and arranged to contact at least a portion of the breasts of the wearer. The second layer may include a layer of foam including an outer surface, an inner surface and a plurality of openings that extend from the inner surface to the outer surface. The third layer may include a first outer cloth. The fourth layer may include a second outer cloth. The fifth layer may include a third outer cloth.

According to yet another aspect, the invention is a pad component constructed and arranged to be used in a brassiere. The pad component may include a layer of foam including an outer surface, an inner surface and a plurality of openings that extend from the inner surface to the outer surface, an inner cloth constructed and arranged to be attached to at least a portion of the inner surface, and a first outer cloth constructed and arranged to be attached to at least a portion of the outer surface. The plurality of openings may include at least a first and a second cross-section, wherein the first cross-section is different than the second cross-section.

According to a further aspect, the invention is a wicking material. The wicking material may include at least 1% elastic fibers and wicking fibers. The wicking material may be constructed and arranged to move water at least 15 centimeters in at least one direction along the wicking material in approximately 30 minutes.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

Various embodiments of the invention will now be described, by way of example, with reference to the accompanying drawings, in which:

FIG. 8A is a chart depicting a bra grading based upon a standard size; and

DETAILED DESCRIPTION OF THE INVENTION

The invention is generally directed to a brassiere, brassiere components and materials thereof, and more particularly to a sports bra with one or more improved characteristics, such as, for example, appearance comfort, support and moisture management capabilities. The brassiere covers and supports the wearer's breasts while being breathable and allowing moisture to permeate the materials. The brassiere may include breast-supporting pads that each includes a pad component and a second outer cloth that may help mask any discoloration of the pad component. The pad component may include an inner cloth and a first outer cloth that are respectively attached to an inner surface and an outer surface of a foam layer. The foam layer may have a plurality of openings that extend throughout the thickness of the layer, from the inner surface to the outer surface of the foam layer, to encourage breathability of the pad. The openings may include a changing cross-section from inside to outside of the pad. The pad may be formed as a molded foam cup to more closely conform to the wearer's contours. The inner cloth and first outer cloth may include materials that are breathable and may have wicking properties. In addition to the pad, the brassiere may include a wicking layer adapted to lie adjacent a wearer's skin to pull moisture away from the skin. The brassiere may also include an outer layer adapted to lie most distal the user's skin that may provide an aesthetically pleasing exterior of the brassiere. Any suitable material may be used to construct the bra. In one embodiment, a novel material, such as a wicking material including at least 1% elastic fibers and wicking fibers, with the wicking fibers moving water at least 15 centimeters. in at least one direction along the wicking material in approximately 30 minutes, may be used.

The aspects of the present invention may be employed singularly or in any suitable combination as the present invention is not limited in this respect. Also, any or all of the these aspects may be employed in a bra, such as a sport bra; however, the present invention is not limited in this respect, as aspects of the invention may be used in bras for general wear, referred to as intimate bras, or with any article of clothing, including other sports/active wear, casual wear, dress wear and/or formal wear. Various aspects and embodiments of the invention will now be described in more detail with respect to the accompanying figures. The invention is not, however, limited to the aspects and embodiments shown. In some of the figures that follow, specific numerical values are used to describe the elements and/or performance/size parameters. It should be appreciated that such values are not necessarily limiting, but rather, that the values may fall within a range of acceptable limits.

Figure 1:
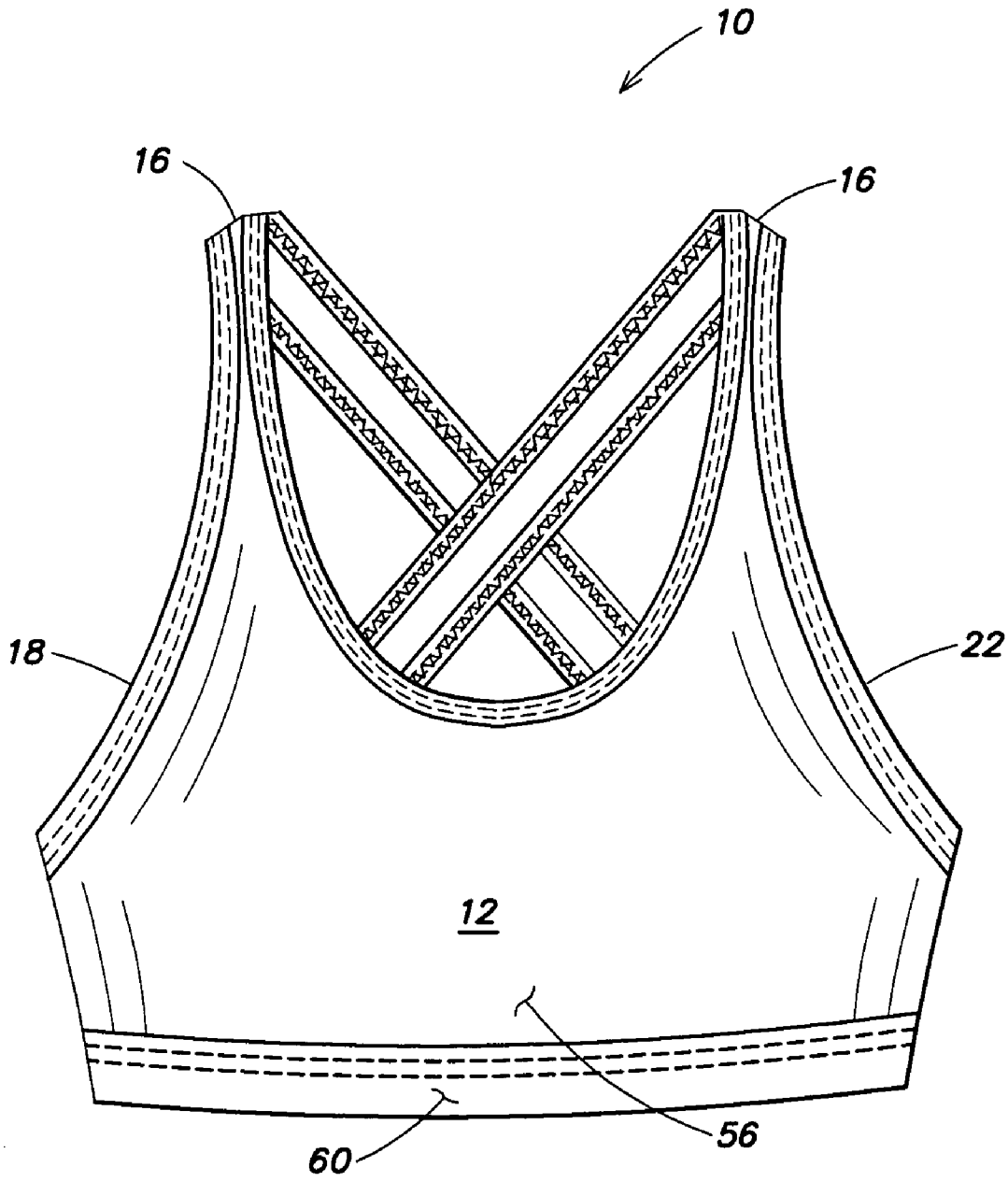
FIG. 1 is a front view of an illustrative embodiment of a brassiere.
Figure 2:
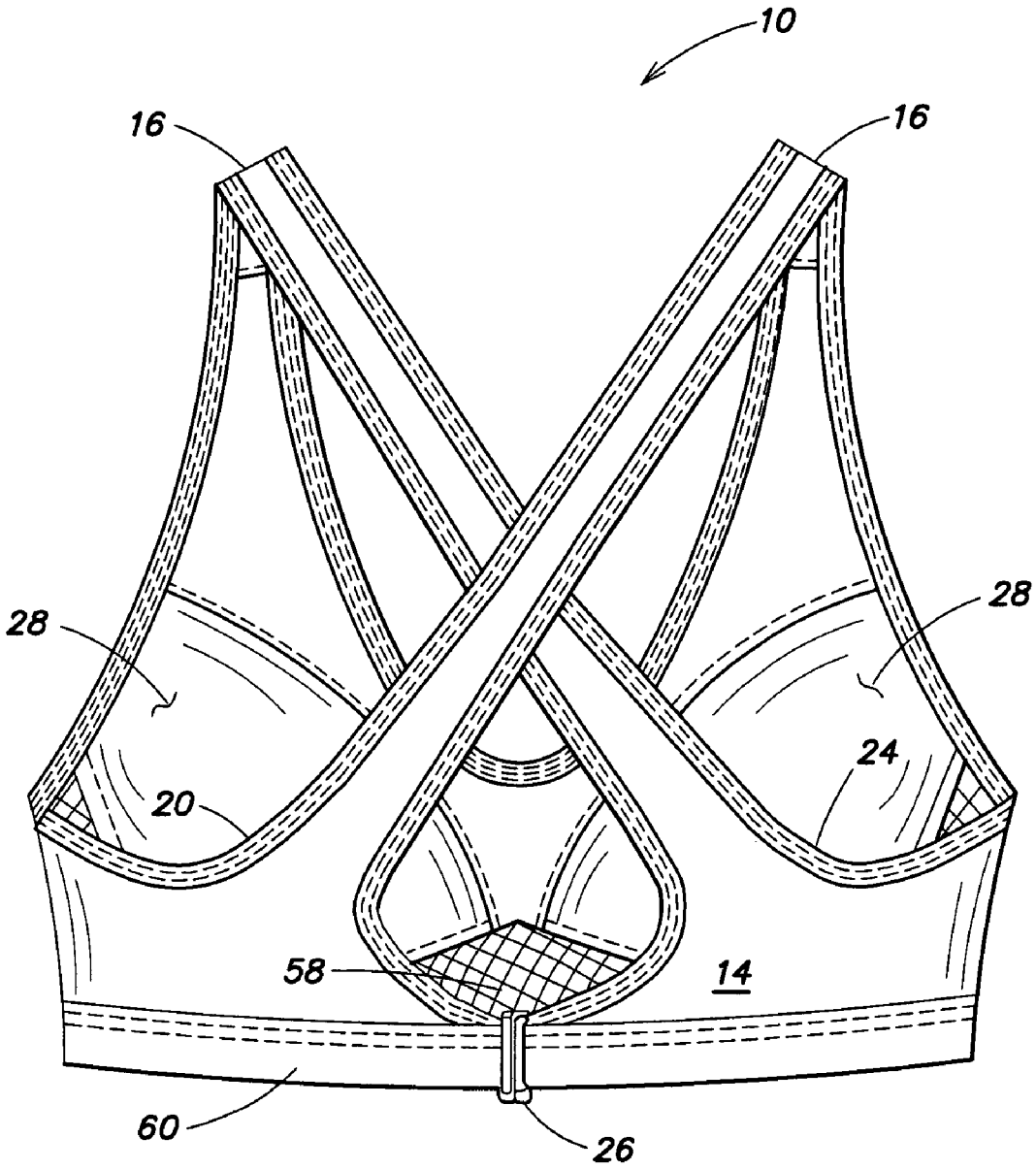
FIG. 2 is a back view of the brassiere of FIG. 1.

Brassiere 10, illustrated in FIGS. 1-2, extends around the chest of a wearer and includes a front portion 12 that is connected to a back portion 14 in an area under the arms of the wearer. Shoulder straps 16 may also be included; however, the present invention is not limited in this respect, as no shoulder straps need be employed.

Figure 3:
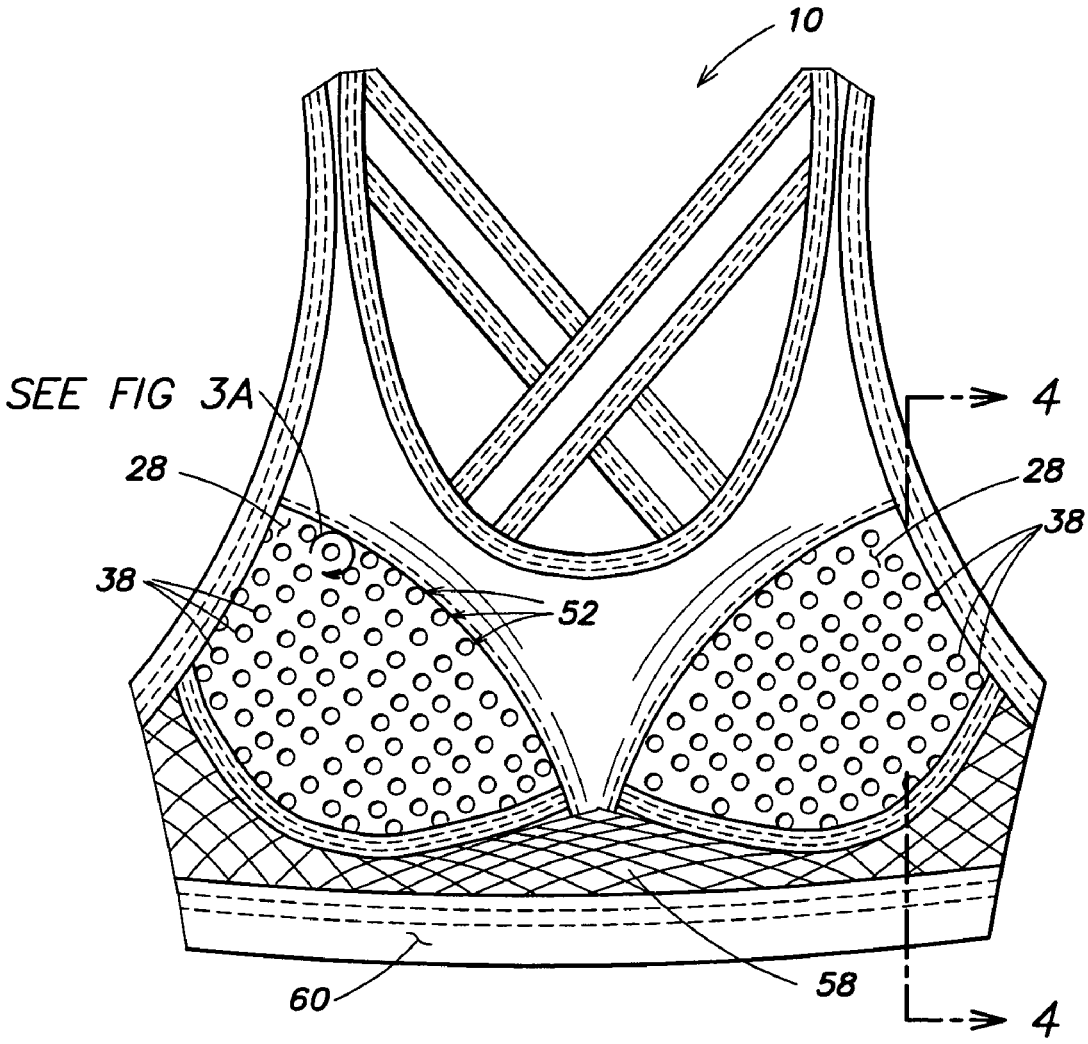
FIG. 3 is a view of the interior of the front portion of an illustrative embodiment of a brassiere.

To provide support for the wearer's breasts, the brassiere 10 may include at least one, and preferably two, pads 28 that may be positioned on an interior of the front portion 12 of the brassiere 10, as shown in FIGS. 2-3. Each pad 28 may be shaped to cover and support the breast. The pad is shaped to follow the contours of the wearer's breast. In one embodiment, the pads may have curved upper and lower edges. At one end, the edges meet as shown. At the opposite end, the upper and lower edges are joined by a side arc shaped edge located near the arm hole. Such an embodiment is shown in FIG. 3. In another embodiment, the upper and lower edges of the pads, while curved as above, join at each end. It should be appreciated that the pads may have any shape as the present invention is not limited in this respect.

As shown in FIG. 3, the bra may include a wire channel at an area below the wearer's breast near the lower edge of the pad. However, the present invention is not limited in this respect, as the bra may be constructed without such a wire channel and instead may include a flat stitched seam at that location.

Figure 4:
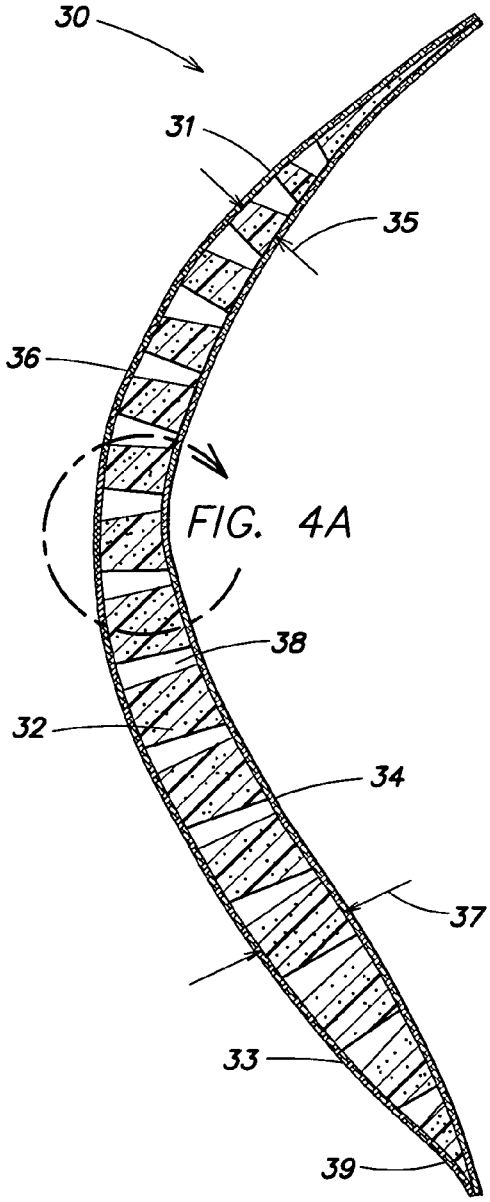
FIG. 4 is a cross-sectional view of the pad component taken along line 4-4 of FIG. 3.

In one embodiment, the pad is formed with a pad component 30. As shown in FIG. 4, the pad component 30 includes a foam layer 32 to which an inner cloth 34 and a first outer cloth 36 is attached. The foam layer 32 may be a polyurethane foam, for example, as is available from Regina Miracle International Ltd. located in the Guangdong province of China The foam is preferably open-celled, but may also be closed-cell. The foam may be stretchable and/or have elastic properties such that the foam may be capable of resuming its substantially original shape after stretching or compressing.

Additionally, other substances, such as coatings or finishes, may be incorporated into the foam layer 32 to add, enhance or alter properties of the foam. For example, the foam layer 32 may be treated with an antibacterial, such as Triclosan (2,4,4'-trichloro-2'hydroxydiphenyl ether) or Schoeller®-deoline, available from Schoeller Textiles AG located in Sevelen, Switzerland or A.M.Y. available from Unifi of NC, USA, or any other brand of antibacterial, to inhibit odors and micro-organisms. In addition, the foam layer 32 may have any coloring, pattern or texture and/or may be impregnated with a scent or deodorizer, as the present invention is not limited in this respect.

The foam may have a thickness sufficient to provide support for the wearer's breast. In one embodiment, the foam has a thickness between approximately 1/16 of an inch and approximately 1/8 of an inch. The thickness of the foam may also be less than 1/16 of an inch or greater than 1/8 of an inch.

In one embodiment, the thickness of the foam layer 32 may be uniform, such that the thickness of the foam layer 32 at an upper portion is the same as the thickness of the foam layer 32 at a lower portion, and at sections therebetween. In another embodiment and as depicted in FIG. 4, an upper thickness 35 of the foam layer 32 in an upper portion 31 is less than a lower thickness 37 of the foam layer 32 in a lower portion 33. Because the breast will weigh more heavily on the lower portion 33 than on the upper portion 31, the lower portion 33 may be thicker to better support this greater weight. Accordingly, the upper portion 31 will have less weight to support, therefore, the upper portion 31 may have a lesser thickness. It should be appreciated that the present invention is not limited in this respect and that comfort, aesthetics, manufacturing and other considerations may dictate other foam thicknesses. For example, the thickness at the lowest portion 39 of the foam layer may be less than the lower thickness 37 and, in some embodiments, may be less than the upper thickness 35.

Figure 4A:
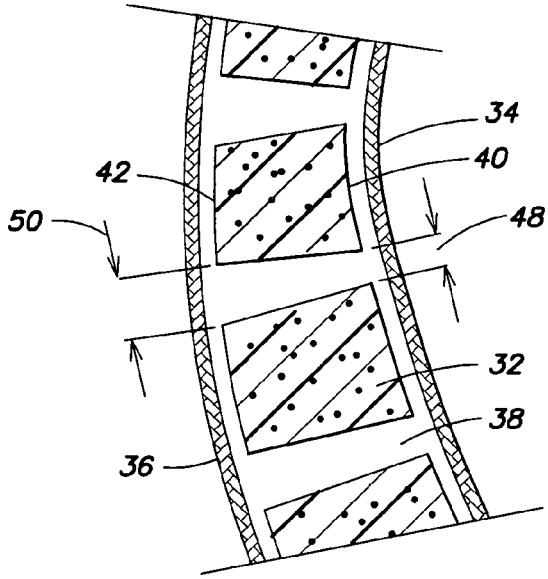
FIG. 4A is an enlarged, cross-sectional view of the pad component encircled by line 4A of FIG. 4.

To facilitate perspiration in evaporating through the foam, in one embodiment, the foam layer 32 has openings 38 formed therethrough. As can be seen in FIG. 4A, the openings 38 extend from an inner surface 40 of the foam layer 32 (e.g. the surface of the foam layer most proximate the wearer) to an outer surface of the foam layer 42 (e.g. the surface of the foam layer most distal the wearer).

Figure 3A:
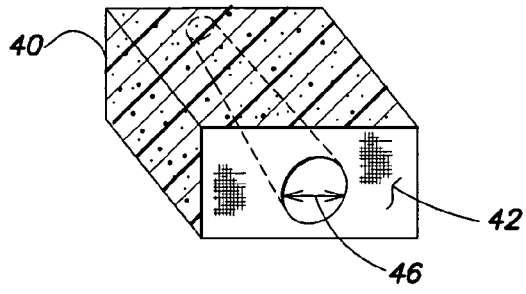
FIG. 3A is an enlarged, perspective view of one of the openings of the brassiere encircled by line 3A of FIG. 3.

In FIGS. 3 and 3A, the cross-sectional area of the openings 38 is shown as being circular. The diameter 46 of this circular cross-sectional area of the opening 38 may range between approximately 0.05 centimeters and approximately 0.5 centimeters. The diameter 46 of the openings 38 may also be less than 0.05 centimeters or may be greater than 0.5 centimeters. It should be appreciated that the cross-sectional area of the opening may be shaped like a circle, square, triangle, pentagon, hexagon, octagon, heart, star, or any other shape, as the present invention is not limited in this respect. Accordingly, the three dimensional shape of the opening may be any shape, such as conical, cylindrical, cubical, cuboidical, or any other shape, as the present invention is not limited in this respect.

In a preferred embodiment, the openings 38 extend all the way from the inner surface 40 of the foam layer 32 to the outer surface 42 of the foam layer 32. It should be appreciated that the openings 38 need not extend through the entire thickness of the foam layer 32 and may extend from one surface partially through the layer 32, but not completely through to the other surface (not shown). In addition, in the illustrative embodiment shown, the central axis of the opening is generally straight and perpendicular to the surface of the foam; however, the invention is not limited in this respect, as the axis may be curved and/or extend at one or more angles (which can be perpendicular or offset) relative to the foam surface.

The openings 38 may be uniformly or randomly distributed throughout the foam. In one embodiment, each square centimeter of the inner surface 40 and/or outer surface 42 of the foam layer 32 includes at least a portion of an opening 38. In addition or alternatively, each opening may be spaced between approximately 0.25 centimeters and approximately 2.5 centimeters from at least one other opening. It should be appreciated that the space between openings may be less than 0.25 centimeters and/or greater than 2.5 centimeters, as the present invention is not limited in this respect.

In another embodiment and as seen in FIG. 3, the foam layer 32 contains substantially parallel rows 52 wherein each opening 38 in the row is spaced approximately 1 centimeter from its neighboring openings and each row is spaced approximately 1 centimeter from its neighboring rows. It should be appreciated that the openings need not be aligned in rows and may be in any pattern, such as concentric circles centered about any general location, such as the location of the nipple, or randomly distributed throughout the layer, as the present invention is not intended to be limiting in this respect.

The foam layer may be molded or shaped to conform to the shape of a breast (e.g. hemisphere, hemispheroid, half-droplet, or other shape). In a preferred embodiment, the foam layer 32 is molded, such that there are no seams that cross a surface of the foam layer 32. The foam layer may be molded by any means, such as bullet molding, hot or cold forming or pressing, injection molding, die molding or any other way, as the present invention is not intended to be limited in this manner. In an alternative embodiment, the foam layer may be shaped to conform to a breast's shape by joining together pieces of foam at angles, such as by sewing, or using conventional 'cut and sew' techniques.

For manufacturing ease and/or for increased comfort and/or appearance, the foam layer is initially formed from a flat sheet. Openings 38 are then drilled, punched, cut or otherwise formed in the layer. The openings now have a generally constant cross-sectional area. In one embodiment, the foam layer is subsequently molded on a bullet mold to the size and shape desired. As a result, as shown in FIG. 4A, the openings 38 may have a conical frustum-like shape, such that an inner cross-sectional area 48 of the opening 38 may be smaller than an outer cross-sectional area 50 of the opening 38. This occurs because the outer surface is stretched or formed over a greater distance than the inner surface when being shaped onto the bullet mold. Of course, the present invention is not limited in this respect, as the diameter 46 of the openings 38 may be unvarying along the length of the opening, such that any inner cross-sectional area is the same as the outer cross-sectional area.

The foam layer 32 may be molded before being attached to the inner and first outer cloths 34, 36 or the inner and first outer cloths 34, 36 may first be attached to the foam layer 32 and then the entire pad component 30 may be molded as a unit. In addition, the inner and first outer cloths 34, 36 may not be molded at all. In one embodiment, by attaching the inner and first outer cloths 34, 36 to the foam layer 32, they may assume the curvature of the foam layer 32.

As discussed above, an inner cloth 34 may be attached to an inner surface 40 of the foam layer 32 and a first outer cloth 36 may be attached to an outer surface 42 of the foam layer 32. In one embodiment, substantially the entire inner and first outer cloths 34, 36 are laminated to the pad component. In addition or alternatively to laminating, the inner and first outer cloths 34, 36 may be attached to the foam layer by gluing, sewing, fusing or any other means of attachment, as the present invention is not intended to be limiting in this respect. In an alternative embodiment, only the edges of the inner and first outer cloths 34, 36 may be attached to the foam layer 32. In addition or alternatively, discrete portions of the inner and first outer cloths 34, 36 may be attached to the foam layer 32. It should be appreciated that any portion of the inner and first outer cloths 34, 36 may be attached to any portion of foam layer 32 as the present invention is not intended to be limiting in this respect.

For increased comfort, the inner cloth 34 may cover the entire inner surface 40 of the foam layer 32. In addition or alternatively, the first outer cloth 36 may cover the entire outer surface 42 of the foam layer 32. However, it should be appreciated that the inner and first outer cloths 34, 36 need not respectively cover the entire inner and outer surfaces 40, 42 of the foam layer 32 and may only cover discrete portions. For example, the inner cloth 34 may cover the entire inner surface 40 while the first outer cloth 36 may only cover the center portion of the pad (e.g. the areolar area of a nipple). At least a portion of each of the inner and first outer cloths 34, 36 should respectively be attached to the inner and outer surfaces 40, 42 of the foam layer 32; however, the portion may include the center area, one or more edges, discrete areas, the entire surface, any other area or any combination thereof, as the present invention is not intended to be limiting in this respect.

In one embodiment, the inner and first outer cloths 34, 36 may be made from a flexible material, such as polyester, such as ComFortrel XP®, ComFortrelPlus®, Holofiber™, MicroSpun®, Sensura® or Spunnaire®, available from Wellman, Inc. located in Shrewsbury, N.J., CoolMax®, Dacron®, Micromattique™ or ThermaStat®, available from DuPont located in Wilmington, Del., or ESP®, Finesse® or Micronesse®, Micro®, available from KoSa located in Houston, Tex. or any polyester fabric that is available from Unifi of N.C., or any other brand of polyester; nylon, such as Anso-tex®, Capima®, Caplana®, Caprolan®, Caprolan-RC®, Captiva®, Crème de Captiva®, Eclipse™, Hydrofil®, Patina®, SeaGard®, StayGard®, Spectra®, or Tru-Ballistic, available from Honeywell Performance Fibers (formerly AlliedSignal Performance Fibers) located in Colonial Heights, Va., or Cordoura®, MicroSupplex®, Supplex® or Tactel®, available from DuPont or any nylon fabric that is available from Unifi of N.C., or any other brand of nylon; spandex, such as Lycra® available from DuPont, or Dorlastan®, available from Dorlastan Fibers LLC, located in Goose Creek, S.C.; cotton; wool; silk; linen; any other natural or synthetic materials or any blend thereof, as the present invention is not limited in this respect.

The material of the inner and first outer cloths 34, 36 may be stretchable and/or have elastic properties. The inner and first outer cloths 34, 36 may also be breathable so that fluids, such as air, can pass from one side of the cloth to the other, and/or have wicking properties so that liquids, such as perspiration, can be transported from one surface of the material, to the other surface. The inner and first outer cloths 34, 36 may also be treated with an anti-bacterial agent, be scented and/or have any color or pattern, as the present invention is not intended to be limited in this respect.

To further increase the breathability of the inner and first outer cloths 34, 36, the material of the cloths 34, 36 may be perforated with openings. In one embodiment wherein the cloths 34, 36 are laminated to and molded with the foam layer 32 before openings 38 are formed in the foam layer 32, the openings may be punched through the inner and first outer cloths 34, 36 as well as the foam layer 32, resulting in the entire pad component 30 having openings therethrough. In addition or alternatively, the inner and first outer cloths 34, 36 may have holes drilled, punched, cut or otherwise formed therethrough separately from the openings 38 in the foam layer 32; the holes may or may not align with the openings 38 when the cloths 34, 36 are attached to the foam layer 32.

Although described simultaneously above, it should be appreciated that the inner cloth 34 may have different properties, such as material, dimensions, characteristics or any other properties, than the first outer cloth 36. The inner cloth 34 may also be attached to the foam layer 32 differently, may have a different shape or mold and/or may have different holes than the first outer cloth 36 as the present invention is not intended to be limiting in this manner. For example, the inner and outer cloths 34, 36 may be polyester or nylon or any combination thereof that are laminated to the surfaces of the foam layer 32 and then bullet molded to provide the desired shape. Alternatively, the foam layer 32 may be pre-molded and then sewn to the inner and outer cloths 34, 36.

Figure 5:
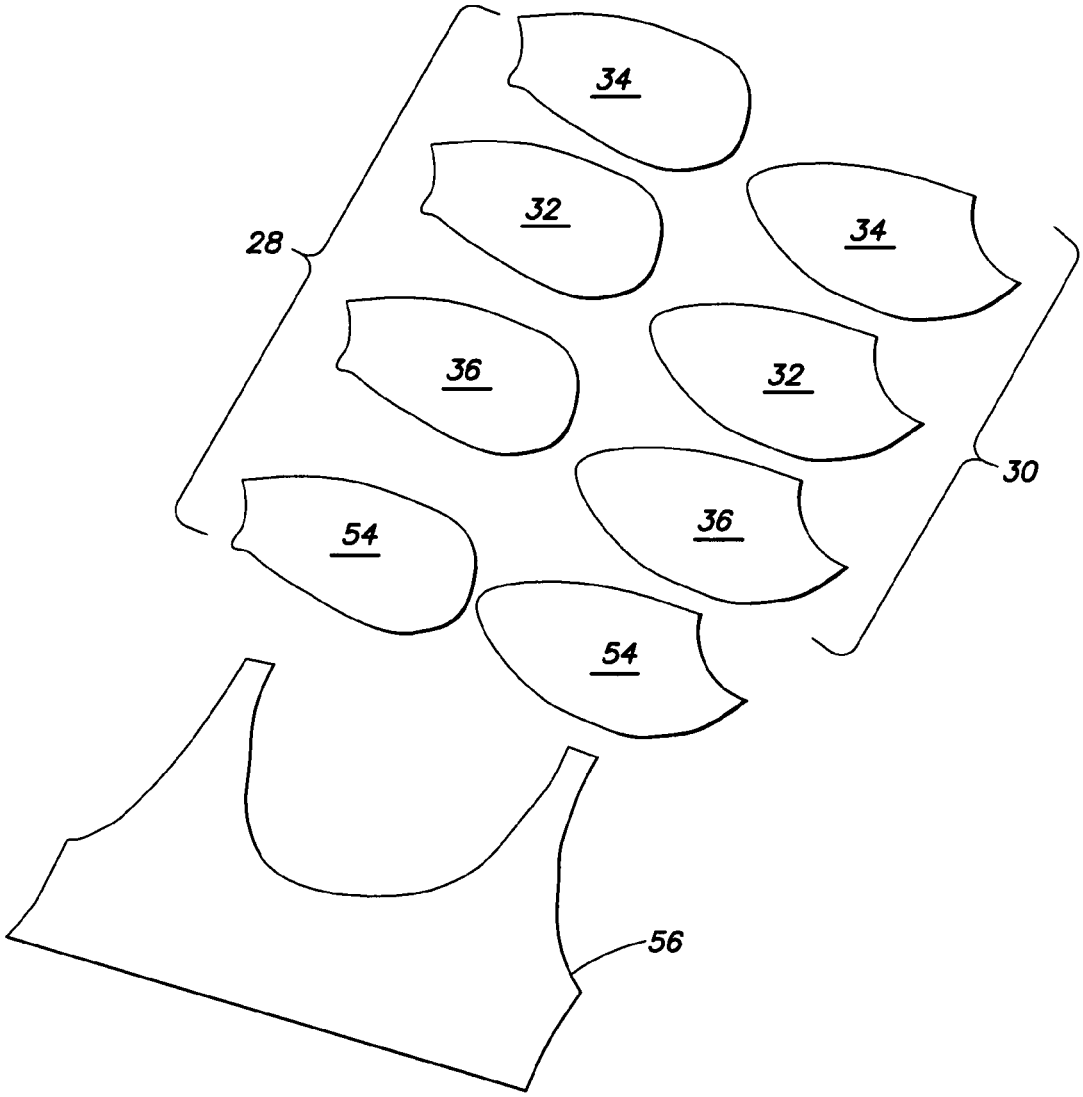
FIG. 5 is an exploded, perspective view of an illustrative embodiment of the brassiere.

Over time, certain foams or materials may darken in color and appear yellow, an undesirable color to show through in a white or lightly colored brassiere. In addition to the pad component, the pad may include a second outer cloth 54 to assist in concealing the discoloration of the pad component from view when the brassiere is viewed from an outermost surface (e.g. a surface of the brassiere most distal the wearer). As shown in FIG. 5, the second outer cloth 54 may be attached to the pad component 30 and lie between the pad component and the front panel 56. In one embodiment the second outer cloth 54 is sewn to an edge of the pad component 30 including the first outer cloth 36, the foam layer 32 and the inner cloth 34. In another embodiment the second outer cloth 54 is glued or laminated to the entire surface of the first outer cloth 36. The second outer cloth 54 may be attached to any area of the pad component, such as an edge, the center, discrete areas or any other area of combination thereof, may be attached to any of layers of the pad component, such as the inner cloth, foam layer or first outer cloth, or any combination thereof, and may be attached to the pad component by sewing, gluing, laminating, fusing, or any other means of attachment, as the present invention is not intended to be limiting in these respects.

As described above with regard to the inner and first outer cloths, the second outer cloth 54 may be any material, such as polyester, nylon, spandex, cotton, silk, or any other natural or synthetic fibers or combinations thereof, with any additional properties, such as wicking, breathable, elastic, anti-bacterial, scented, colored or textured. In addition, the second outer cloth may be molded separately, molded with some or all of the other layers 32, 34, 36 or not molded at all. In one embodiment, the second outer cloth 54 is approximately the same size as the pad component. Alternatively the second outer cloth 54 can have any dimensions, as the present invention is not limited in this respect. In one embodiment, the second outer cloth 54 is formed at least in part with Simplex®, available from Nylatex of Nothingham, UK, which has an approximately 84% polyester and approximately 16% Lycra® blend.

To further move perspiration away from a wearer's skin, a wicking layer 58 may be incorporated into the brassiere. The wicking layer 58 may include a wicking fiber to transport the water and an elastic fiber to allow the layer to stretch, thereby making the fabric more comfortable for the wearer. In one embodiment and as shown in FIG. 2, the wicking layer 58 may contact the area directly underneath a wearer's breasts, where perspiration will commonly accumulate. Of course, the present invention is not limited in this respect, as the wicking layer 58 may be placed at other suitable locations.

The wicking fiber may catch the moisture that gathers at the skin of a wearer and transport it along the fiber away from the skin, to where it may be more quickly evaporated. In one embodiment, the wicking fiber is a Sorbtek™ fiber, available from UNIFI®, Inc. located in Yadkinville, N.C. The Sorbtek™ fiber may be a polyester or nylon fiber with a semi-dull luster and may have a denier of 2/50/36, 1/70/34, 1/100/34, 1/100/136, 1/150/68, 1/150/200, 2/100/34, 3/150/68, 2/300/68, or any other denier. In alternative embodiments, ComFortrel XP® or ComFortrelPlus® fibers, available from Wellman, Inc. located in Shrewsbury, N.J., CoolMax® or ThermaStat® fibers, available from DuPont located in Wilmington, Del., or Hydrofil® fibers, available from Honeywell Performance Fibers (formerly AlliedSignal Performance Fibers) located in Colonial Heights, Va., may be used as a wicking fiber, as the present invention is not limited in this respect.

To increase the comfort of a layer that includes a wicking fiber, an elastic fiber may be incorporated into the weave. The elastic fiber may be any fiber that is capable of resuming substantially its original shape after stretching or compressing or has significant rebound properties. In one embodiment the elastic fiber is a spandex fiber, such as a Lycra® fiber or a Dorlastan® fiber. It should be appreciated that the elastic fiber may be any fiber having elastic properties, as the present invention is not limited in this respect.

The elastic and wicking fibers may be woven together to create a wicking layer having certain wicking properties. In one embodiment, the wicking layer may contain 4% elastic fibers and 96% wicking fibers. In an alternative embodiment, the wicking layer may contain 1% elastic fibers and 99% wicking fibers. The percent composition of elastic fibers may be less than 1%, between 1% and 4%, or greater than 4% and the percent composition of wicking fibers may be greater than 99%, between 96% and 99% or may be less than 96%, as the present invention is not intended to be limiting in this respect. It should be further appreciated that one or more additional types of fibers may be incorporated to form the wicking layer.

Additionally, other substances, such as coatings or finishes, may be incorporated into the layer to add, enhance or alter properties of the layer. For example, the wicking layer may be treated with an anti-bacterial agent, be scented and/or have any color, pattern or texture, as the present invention is not intended to be limited in this respect.

The wicking characteristics of the wicking layer may include the ability to move a liquid at least 15 centimeters in 30 minutes. The liquid, such as water, may be transported along the fabric in a vertical, horizontal or other direction. A standard test to measure the ability of a fabric to wick or transport water by way of capillary action is performed, as is explained further in Example 1.

As shown in FIGS. 1 and 5, in one embodiment, the brassiere includes panel or outer layer 56 as the outermost surface of the brassiere. The outer layer 56 may be attached directly or indirectly, such as via the wicking layer, to the pad.

As described above with regard to the inner and first outer cloths, the outer layer 56 may be any material, such as polyester, nylon, spandex, cotton, silk, or any other natural or synthetic fibers or combinations thereof, with any additional properties, such as wicking, breathable, elastic, anti-bacterial, scented, colored, or textured. In addition, the outer layer may be molded separately, molded with some or all of the other layers 32, 34, 36 or not molded at all. In one embodiment, the outer layer 56 is approximately the same size as the pad component. Alternatively the outer layer 56 can have any dimensions, as the present invention is not limited in this respect.

To both provide additional support for the breasts and to secure the brassiere in the desired location on the wearer, the brassiere 10 may further include an elastic band 60. As can be seen in FIGS. 1-3, the elastic band 60 may be constructed and arranged to lie below the wicking layer 58 and the pads 28, accordingly below the wearer's breasts, and circumvent the wearer's chest. It should be appreciated that the brassiere may or may not have an elastic band as the present invention is not limited in this respect. To provide further support for the breasts, in one embodiment, the brassiere may also include underwire near the bottom portion of the cup.

As discussed above, the brassiere 10 may further include shoulder straps 16. The shoulder straps are preferably formed with and extend from the front portion 12 to the back portion 14 of the brassiere. The shoulder straps 16 may connect the same sides of the front portion and the back portion, such as connecting the right side 18 of the front portion 12 to the right side 24 of the back portion 14 or the left side 22 of the front portion 12 to the left side 20 of the back portion 14 (not shown), may cross to connect opposing sides as shown in FIGS. 1 and 2, such as connecting the right side 18 of the front portion 12 to the left side 20 of the back portion 14 or connecting the left side 22 of the front portion 12 to the right side 24 of the back portion 14, may be a halter strap or a racerback (not shown), or may include any other configuration of shoulder straps as the present invention is not intended to be limiting in this way. Additionally, the brassiere may have any number of straps, such as one, two, four, or no shoulder straps at all, such as a tube-style bra (not shown). Further, in one embodiment, the width of the strap is approximately 1¼ inch; however the invention is not limited in this respect.

The brassiere 10 may include a fastener 26, such as hook and eye fasteners, clasps, string ties, zippers or buttons, to facilitate the wearer in putting on and removing the brassiere. In one embodiment and as shown in FIG. 2, the fastener 26 is located in the middle of the back portion 14 of the brassiere. Alternatively, the fastener can be located on the front portion 12 of the brassiere, such as a zipper in between the wearer's breasts (not shown). In an alterative embodiment, the brassiere includes no such fastener and is put on and removed by pulling the garment over the wearer's head or slid on in another fashion. The brassiere may include any other fasteners or means for putting on and removing the brassiere as the present invention is not intended to be limiting in this way.

Figure 8B:
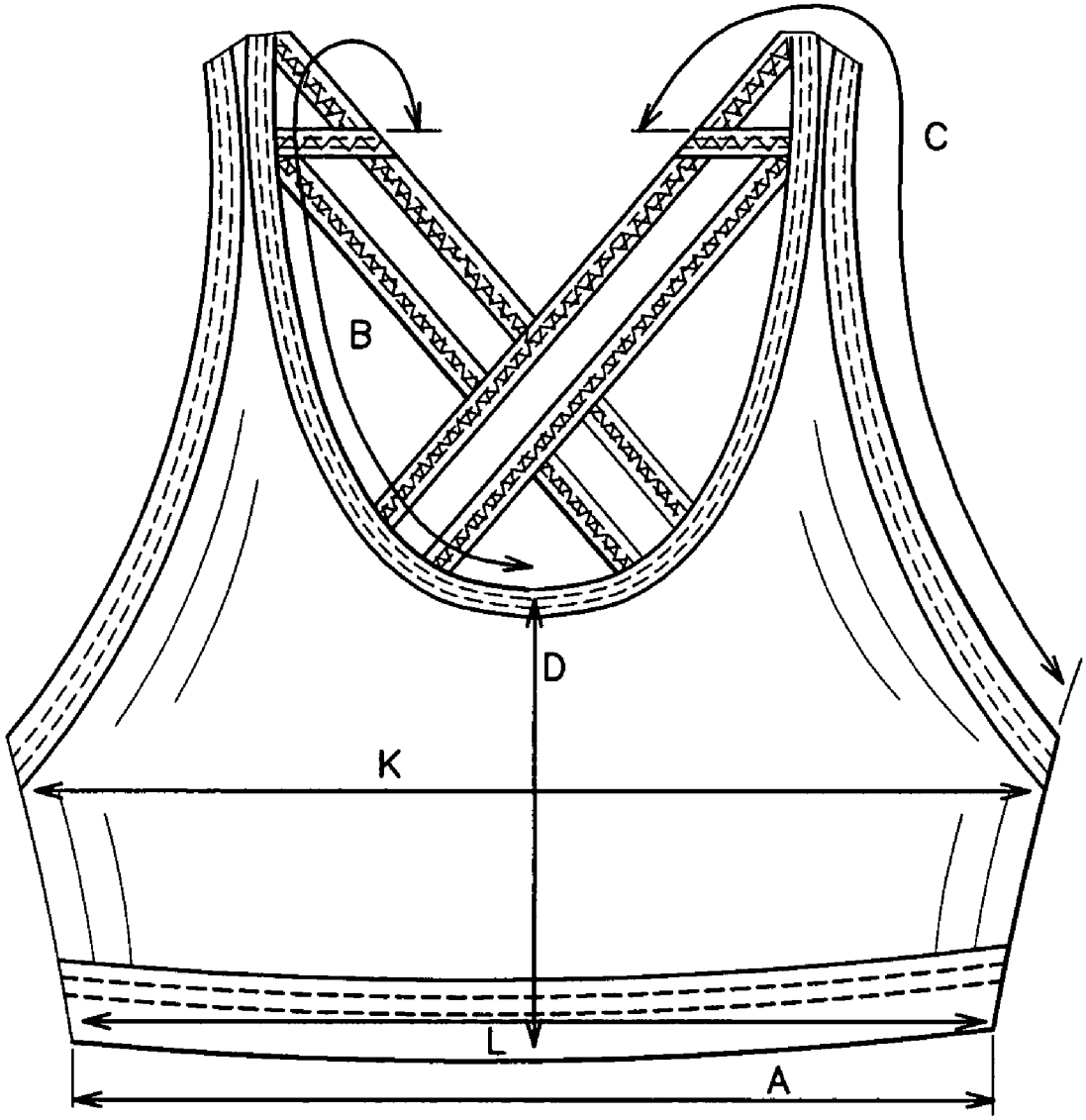
FIGS. 8B and 8C are front and back views, respectively of a bra and illustrates the corresponding locations for the bra dimensions and/or attributes.
Figure 8C:
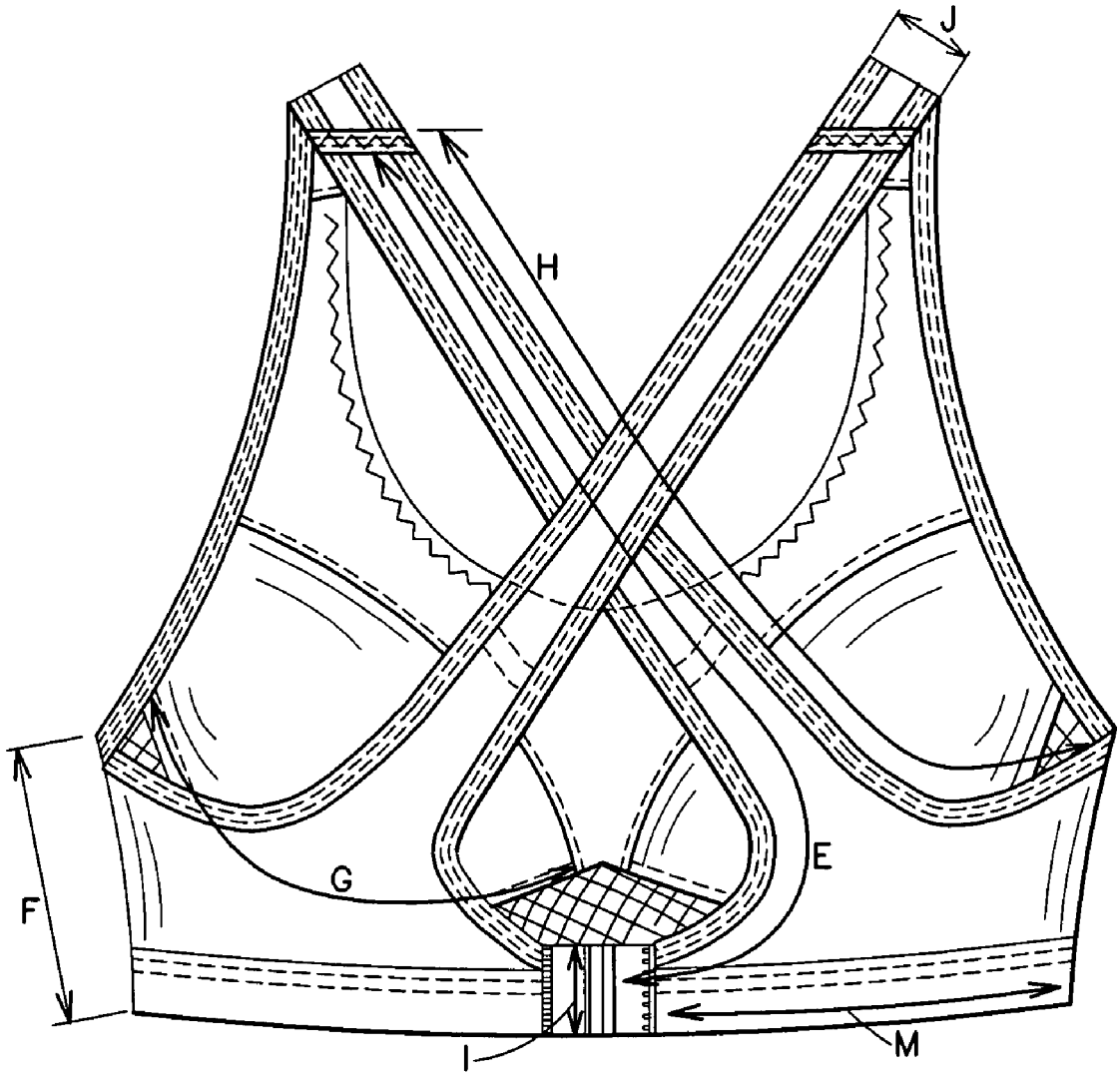

To more easily manufacture brassieres of differing sizes, grading rules may be established to translate a standard sized bra's dimensions into a larger or smaller sized bra's dimensions. An example of such grading is illustrated in FIGS. 8A and 8B, where FIG. 8A represents an exemplary grading chart and FIGS. 8B and 8C are front and back views of a bra and illustrates the corresponding locations for the bra dimensions and/or attributes. In FIGS. 8A-8C, bra size 34B is considered the standard and has dimensions A-M. Once the dimensions A-M for size 34B have been selected, each other bra size's dimensions may be readily available by either increasing, decreasing or maintaining the particular dimension at issue by the amount listed in the chart. Thus, for example, dimension C (Front Armhole Height) for a bra size 32B is ¼ inch less than the corresponding dimension for a bra size 34B. Similarly, for example, dimension G (Cup Base Length (No Wire)) for a bra size 34DD is 1⅞ inches greater than the corresponding dimension for a bra size 34B. Similarly, for example, dimension A (Bottom Band Relaxed Circumference) for a bra size 32B is the same as the corresponding dimension for a bra size 34B.

Brassieres may be given any general size designations such as small, medium or large, or may be given brassiere size designations, such as 34B, 36C or 38DD. The number associated with a brassiere size designation represents the band size, or frame size, which is based on the circumference of the rib cage below the breasts. The letter of a brassiere size designation represents the cup size, which is based on the difference between the band size and the circumference of the bust or breasts. Certain dimensions may be constant between bras of the same band size or bras of the same cup size while other dimensions may vary, as will be discussed further below. For dimension measuring purposes, if the brassiere contains an adjustable fastener 104, such as a hook and eye clasp, then the fastener 104 should be set at the smallest or tightest setting.

Figure 6:
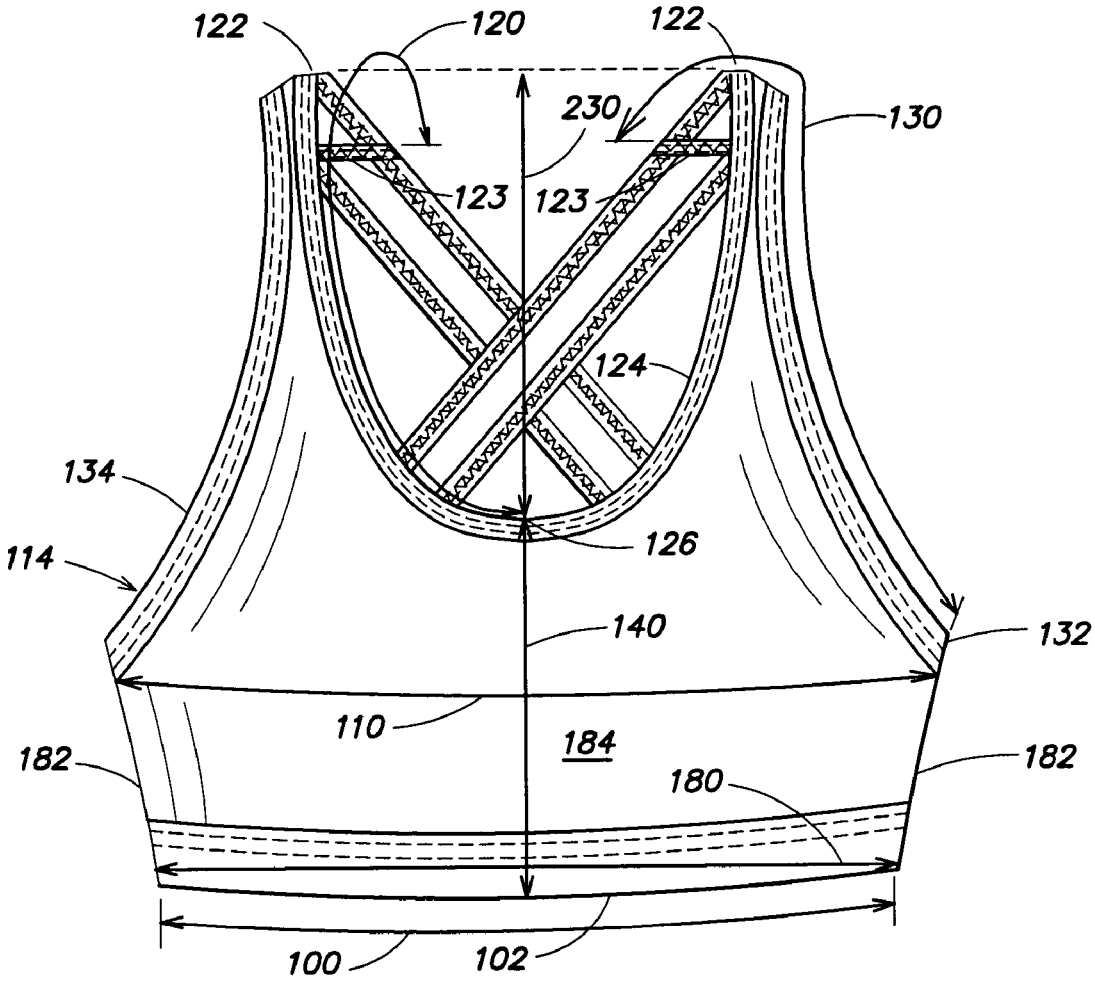
FIG. 6 is a front view of an illustrative embodiment of a brassiere.
Figure 7:
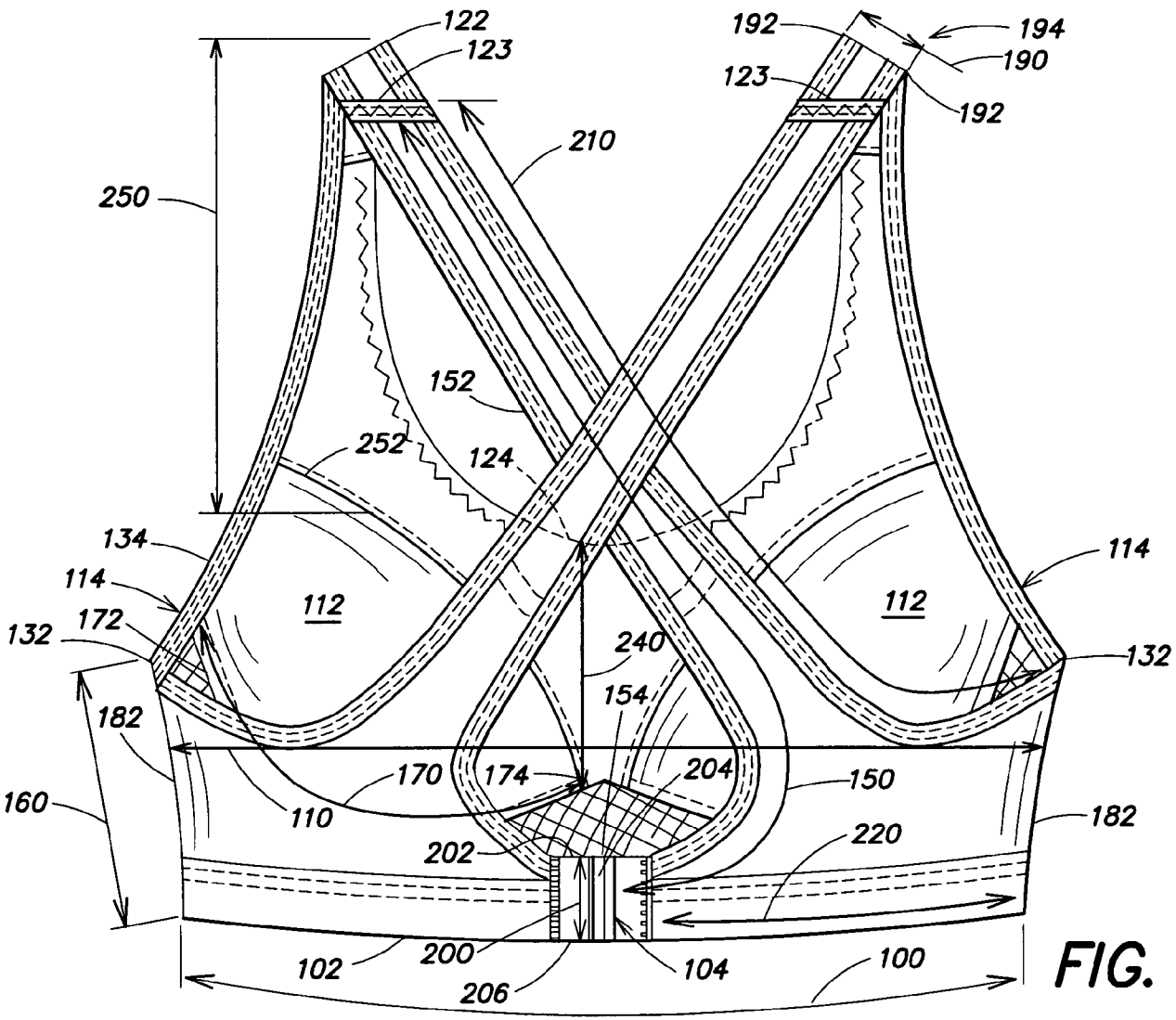
FIG. 7 is a back view of the brassiere of FIG. 6.

As can be seen in FIGS. 6 and 7, one dimension that directly correlates to band size is a bottom band relaxed circumference 100, which measures along the circumference of the bottom opening edge 102. Although only half of the bottom opening edge 102 is shown in each figure (e.g. only the front portion is shown in FIG. 6 and the back portion is shown in FIG. 7) the bottom band relaxed circumference 100 extends entirely around the bottom opening edge 102. In one embodiment, wherein the brassiere is a 34B bra, the bottom band relaxed circumference 100 is 23¼ inches with a tolerance of approximately ¾ inches. Regardless of cup size, any brassiere having a band size of 34, such as 34B, 34C, 34D or 34DD, may have a bottom band relaxed circumference 100 of 23¼ inches with a tolerance of ¾ inches. For a brassiere having a band size of 32, such as 32B or 32C, the bottom band relaxed circumference 100 may be 22¼ inches with a tolerance of ¾ inches. For a brassiere having a band size of 36, such as 36B, 36C or 36D, the bottom band relaxed circumference 100 may be 25¼ inches with a tolerance of ¾ inches. For a brassiere having a band size of 38, such as 38B or 38C, the bottom band relaxed circumference 100 may be 27¼ inches with a tolerance of ¾ inches.

Another dimension that directly relates to band size is the bust circumference 110, which measures the circumference of the brassiere over the cups 112 and under the armholes 114. Although only half of the brassiere is shown in each figure, the bust circumference 110 extends entirely around the brassiere. In one embodiment, wherein the brassiere is a 34B bra, the bust circumference 110 is 28½ inches with a tolerance of ¾ inches. Regardless of cup size, any brassiere having a band size of 34, such as 34B, 34C, 34D or 34DD, may have a bust circumference 110 of 28½ inches with a tolerance of ¾ inches. For a brassiere having a band size of 32, such as 32B or 32C, the bust circumference 110 may be 27½ inches with a tolerance of ¾ inches. For a brassiere having a band size of 36, such as 36B, 36C or 36D, the bust circumference 110 may be 30½ inches with a tolerance of ¾ inches. For a brassiere having a band size of 38, such as 38B or 38C, the bust circumference 110 may be 32½ inches with a tolerance of ¾ inches.

Some measurements, such as front neckline height, front armhole height, center front length, strap height, wire channeling length and front body width at bottom band may correspond to a combination of band size and cup size, such that sizes 34C and 36B, sizes 34D, 36D and 38B, and sizes 34DD, 36D and 38C respectively have the similar dimensions.

The front neckline height 120 is measured from a shoulder seam 123 (which, in the example shown in FIG. 6, is formed slightly below the highpoint 122 of shoulder on the rear portion of the shoulder strap) to a center front 126 along a neck edge 124. In one embodiment, wherein the brassiere is a 34B bra, the front neckline height 120 is 9⅝ inches with a tolerance of ¼ inches. A corresponding brassiere size, such as 32C, may also have a front neckline height 120 of 9⅝ inches with a tolerance of ¼ inches. For brassieres of sizes such as 34C and 36B, the front neckline height 120 may be 9⅞ inches with a tolerance of ¼ inches. For brassieres of sizes such as 34D, 36C and 38B, the front neckline height 120 may be 10⅛ inches with a tolerance of ¼ inches. For brassieres of sizes such as 34DD, 36D and 38C, the front neckline height 120 may be 10⅜ inches with a tolerance of ¼ inches. For brassieres of a size such as 32B, the front neckline height 120 may be 9⅜ inches with a tolerance of ¼ inches.

The front armhole length 130 is measured from a shoulder seam 123 (which, in the example shown in FIG. 6, is formed slightly below the highpoint of shoulder on the rear portion of the shoulder strap) to a side portion 132, commonly demarcated by a seam, along an armhole edge 134. In one embodiment, wherein the brassiere is a 34B bra, the front armhole height 130 is 8¾ inches with a tolerance of ¼ inches. A corresponding brassiere size, such as 32C, may also have a front armhole height 130 of 8¾ inches with a tolerance of ¼ inches. For brassieres of sizes such as 34C and 36B, the front armhole height 130 may be 9 inches with a tolerance of ¼ inches. For brassieres of sizes such as 34D, 36C and 38B, the front armhole height 130 may be 9¼ inches with a tolerance of ¼ inches. For brassieres of sizes such as 34DD, 36D and 38C, the front armhole height 130 may be 9½ inches with a tolerance of ¼ inches. For brassieres of a size such as 32B, the front armhole height 130 may be 8½ inches with a tolerance of ¼ inches.

The center front length 140 is measured from the center front 126 along the neck edge 124 straight down to the bottom opening edge 102. In one embodiment, wherein the brassiere is a 34B bra, the center front length 140 is 5⅛ inches with a tolerance of ¼ inches. A corresponding brassiere size, such as 32C, may also have a center front length 140 of 5⅛ inches with a tolerance of ¼ inches. For brassieres of sizes such as 34C and 36B, the center front length 140 may be 5¼ inches with a tolerance of ¼ inches. For brassieres of sizes such as 34D, 36C and 38B, the center front length 140 may be 5⅜ inches with a tolerance of ¼ inches. For brassieres of sizes such as 34DD, 36D and 38C, the center front length 140 may be 5½ inches with a tolerance of ¼ inches. For brassieres of a size such as 32B, the center front length 140 may be 5 inches with a tolerance of ¼ inches.

The strap length 150 is measured from the shoulder seam 123 along a strap edge 152 to a center back 154 of the brassiere, as shown in FIG. 7. In one embodiment, wherein the brassiere is a 34B bra, the strap height 150 is 11½ inches with a tolerance of ¼ inches. A corresponding brassiere size, such as 32C, may also have a strap height 150 of 11½ inches with a tolerance of ¼ inches. For brassieres of sizes such as 34C and 36B, the strap height 150 may be 11¾ inches with a tolerance of ¼ inches. For brassieres of sizes such as 34D, 36C and 38B, the strap height 150 may be 12 inches with a tolerance of ¼ inches. For brassieres of sizes such as 34DD, 36D and 38C, the strap height 150 may be 12¼ inches with a tolerance of ¼ inches. For brassieres of a size such as 32B, the strap height 150 may be 11¼ inches with a tolerance of ¼ inches.

The side portion length 160, which is sometimes demarcated by a seam, is measured from the side portion 132 of the armhole edge 134 to the bottom opening edge 102. In one embodiment, wherein the brassiere is a 34B bra, the side portion length 160 is 5 inches with a tolerance of ¼ inches. A corresponding brassiere size, such as 32C, may also have a side portion length 160 of 5 inches with a tolerance of ¼ inches. For brassieres of sizes such as 34C and 36B, the side portion length 160 may be 5⅛ inches with a tolerance of ¼ inches. For brassieres of sizes such as 34D, 36C and 38B, the side portion length 160 may be 5¼ inches with a tolerance of ¼ inches. For brassieres of sizes such as 34DD, 36D and 38C, the side portion length 160 may be 5⅜ inches with a tolerance of ¼ inches. For brassieres of a size such as 32B, the side portion length 160 may be 4⅞ inches with a tolerance of ¼ inches.

Even though some embodiments of the present invention do not contain underwires, the wire channeling length 170 is a measurement of the distance from the armhole edge 134 along the bottom of the cup 172 to the inner edge 174 of the cup 112. In one embodiment, wherein the brassiere is a 34B bra, the wire channeling length 170 is 7¾ inches with a tolerance of ¼ inches. A corresponding brassiere size, such as 32C, may also have a wire channeling length 170 of 7¾ inches with a tolerance of ¼ inches. For brassieres of sizes such as 34C and 36B, the wire channeling length 170 may be 8⅜ inches with a tolerance of ¼ inches. For brassieres of sizes such as 34D, 36C and 38B, the wire channeling length 170 may be 9 inches with a tolerance of ¼ inches. For brassieres of sizes such as 34DD, 36D and 38C, the wire channeling length 170 may be 9⅝ inches with a tolerance of ¼ inches. For brassieres of a size such as 32B, the wire channeling length 170 may be 7⅛ inches with a tolerance of ¼ inches.

The front body width 180 at the bottom band is measured from one side 182 of the brassiere to the other side 182 along the bottom opening edge 102 of the front 184 of the brassiere. In one embodiment, wherein the brassiere is a 34B bra, the front body width 180 is 10 inches with a tolerance of ¼ inches. For brassieres of sizes such as 34C and 36B, the front body width 180 may be 11 inches with a tolerance of ¼ inches. For brassieres of sizes such as 34D, 36C and 38B, the front body width 180 may be 12 inches with a tolerance of ¼ inches. For brassieres of sizes such as 34DD, 36D and 38C, the front body width 180 may be 13 inches with a tolerance of ¼ inches. For brassieres of a size such as 32B, the front body width 180 may be 9½ inches with a tolerance of ¼ inches. For brassieres of a size such as 32C, the front body width 180 may be 10½ inches with a tolerance of ¼ inches.

Other measurements, such as strap width at the shoulder and hook and eye tape height, may correspond to a combination of band size and cup size, such that smaller sizes 32B, 32C, 34B, 34C and 36B will have similar dimensions while larger sizes, such as 34D, 34DD, 36C, 36D, 38B and 38C, which may require more support, will have similar dimensions.

The strap width 190 at the shoulder is measured from one side 192 of the shoulder strap to the other side 192 at the top 194 of the brassiere strap. In one embodiment, wherein the brassiere is a 34B bra, the strap width 190 is 1¼ inches with a tolerance of less than ⅛ inches. For brassieres of sizes such as 32B, 32C, 34C and 36B, the strap width 190 may also be 1¼ inches with a tolerance of less than ⅛ inches. For brassieres of sizes such as 34D, 34DD, 36C, 36D, 38B and 38C, the strap width 190 may be 1⅝ inches with a tolerance of less than ⅛ inches.

The fastener tape height 200, such as the hook and eye tape height, is measured from the top 202 of the tape 204 to the bottom 206 of the tape 204. In one embodiment, wherein the brassiere is a 34B bra, the fastener tape height 200 is 1⅛ inches with a tolerance of ⅛ inches. For brassieres of sizes such as 32B, 32C, 34C and 36B, the fastener tape height 200 may also be 1⅛ inches with a tolerance of ⅛ inches. For brassieres of sizes such as 34D, 34DD, 36C, 36D, 38B and 38C, the fastener tape height 200 may be 1¼ inches with a tolerance of ⅛ inches.

The back armhole length 210 is measured from the shoulder seam 123 along the armhole edge to the side portion 132, commonly demarcated by a seam. In one embodiment, wherein the brassiere is a 34B bra, the back armhole height 210 is 12⅜ inches with a tolerance of ¼ inches. For brassieres of a size such as 32B, the back armhole height 210 may be 11⅞ inches with a tolerance of ¼ inches. For brassieres of a size such as 32C, the back armhole height 210 may be 11½ inches with a tolerance of ¼ inches. For brassieres of a size such as 34C, the back armhole height 210 may be 12 inches with a tolerance of ¼ inches. For brassieres of a size such as 34D, the back armhole height 210 may be 11⅝ inches with a tolerance of ¼ inches. For brassieres of a size such as 34DD, the back armhole height 210 may be 11¼ inches with a tolerance of ¼ inches. For brassieres of a size such as 36B, the back armhole height 210 may be 12⅞ inches with a tolerance of ¼ inches. For brassieres of a size such as 36C, the back armhole height 210 may be 12½ inches with a tolerance of ¼ inches. For brassieres of a size such as 36D, the back armhole height 210 may be 12⅛ inches with a tolerance of ¼ inches. For brassieres of a size such as 38B, the back armhole height 210 may be 13⅜ inches with a tolerance of ¼ inches. For brassieres of a size such as 38C, the back armhole height 210 may be 13 inches with a tolerance of ¼ inches.

The back wing body width 220 is measured from the side portion 132, commonly demarcated by a seam, along the bottom opening edge 102 to the fastener 104. In one embodiment, wherein the brassiere is a 34B bra, the back wing body width 220 is 6⅝ inches with a tolerance of ¼ inches. For brassieres of a size such as 36C, the back wing body width 220 may also be 6⅝ inches with a tolerance of ¼ inches. For brassieres of sizes such as 34C and 36D, the back wing body width 220 may be 6⅛ inches with a tolerance of ¼ inches. For brassieres of sizes such as 36B and 38C, the back wing body width 220 may be 7⅛ inches with a tolerance of ¼ inches.

For brassieres of a size such as 32B, the back wing body width 220 may be 6⅜ inches with a tolerance of ¼ inches. For brassieres of a size such as 32C, the back wing body width 220 may be 5⅞ inches with a tolerance of ¼ inches. For brassieres of a size such as 34D, the back wing body width 220 may be 5⅝ inches with a tolerance of ¼ inches. For brassieres of a size such as 34DD, the back wing body width 220 may be 5⅛ inches with a tolerance of ¼ inches. For brassieres of a size such as 38B, the back wing body width 220 may be 7⅝ inches with a tolerance of ¼ inches.

It should be appreciated that the aforementioned dimensions are suggested measurements and the measurements may be less than, more than or equal to the suggested measurements, as the present invention is not intended to be limiting in this respect. Further, each dimension listed is approximate and the present invention should not be construed in a manner which limits the dimensions to exactly that described.

For example, if the brassiere has a zipper closure on the front portion in-between the breasts, certain above-described dimensions, such as the center front length 140, side portion length 160 and strap width 190, may increase or decrease. In one embodiment wherein the zipper front brassiere is a 34C bra, the center front length 140 may be approximately 5⅞ inches, while the center front length 140 of a 34C rear clasp brassiere may be approximately 5⅜ inches. The side portion length 160 of this 34C zipper front brassiere may be approximately 5 inches, compared to the approximately 5¼ inch side portion length 160 of the 34C rear clasp brassiere. The strap width 190 of the 34C zipper front brassiere may be approximately 1⅜ inches, while the strap width 190 of the 34C rear clasp brassiere may be approximately 1⅛ inches.

Other dimensions, such as front neck drop 230, neck-yoke length 240 and shoulder-cup length 250, may be different in the zipper front brassiere as compared to the rear clasp brassiere. The front neck drop 230 is measured from the line extending between the inner highpoints 122 of the shoulder straps (as shown in FIG. 6) perpendicularly down to the center front 126. The front neck drop 230 of the 34C zipper front brassiere may be approximately 6½ inches, while the front neck drop 230 of the 34C rear clasp brassiere may be approximately 6¼ inches.

The neck-yoke length 240 is measured from the inner edge 174 of the cup 112 straight up to the neck edge 124. The neck-yoke length 240 of the 34C zipper front brassiere may be approximately 3¾ inches, while the neck-yoke length 240 of the 34C rear clasp brassiere may be approximately 2⅞ inches.

The shoulder-cup length 250 is measured from the inner highpoint 122 of the shoulder strap straight down to the top edge 252 of the cup 112. The shoulder-cup length 250 of the 34C zipper front brassiere may be approximately 6¼ inches, while the shoulder-cup length 250 of the 34C rear clasp brassiere may be approximately 5¼ inches.

EXAMPLE

Example 1

Testing Method for Vertical Wicking for Synthetic Fabrics

A sample of the wicking layer was washed three times according to AATCC 135 conditions (e.g. machine cycle (3) permanent press, washing temperature III (105+1−5 F), drying procedure (A) tumble (iii) permanent press, utilize liquid Tide detergent, no softener is to be used in either washing or drying phases). Three specimens measuring 6"×1" (15.0×2.5 cm) were cut from the sample each in the warp and filling the direction with the long dimension in the testing direction. All specimens were conditioned in the standard atmosphere for testing textiles before testing.

The test was conducted in the standard atmosphere. Approximately 200 ml water was poured into a 500 ml Erlenmeyer flask and food coloring was added to make the water level visible on the specimen. The distance from the surface of the water to the top of the flask was approximately 6" (15.0 cm).

A straight pin, approximately 3 inches in length, was inserted parallel to the 1" (2.5 cm) dimension at the top edge of the specimen. The test specimen was hung from the top edge of the flask by allowing the straight pin to rest across the opening. The bottom edge of the specimen was just slightly touching the surface of the water.

After 5 minutes, the test specimen was removed and the distance that the water has migrated up the specimen was measured and recorded. The test specimen was placed back into the flask to resume testing. The progress of the migration was visually inspected approximately every 5 minutes.

When the water has migrated the complete 6" (15.0 cm) or when 30 minutes has elapsed, which ever comes first, the test was considered complete. The distance of migration at 5 minute intervals for the warp and fill directions for both the original and washed specimens were recorded.

In one embodiment, where the wicking material includes at least 1% elastic fibers and wicking fibers, the wicking material moved water at least 15 centimeters in at least one direction along the wicking material in approximately 30 minutes.

The foregoing written specification is to be considered to be sufficient to enable one skilled in the art to practice the invention. While the best mode for carrying out the invention has been described in detail, those skilled in the art to which this invention relates will recognize various alternative embodiments including those mentioned above as defined by the following claims. The examples disclosed herein are not to be construed as limiting of the invention as they are intended merely as illustrative of particular embodiments of the invention as enabled herein. Therefore, systems and methods that are functionally equivalent to those described herein are within the spirit and scope of the claims appended hereto. Indeed, various modifications of the invention in addition to those shown and described herein will become apparent to those skilled in the art from the foregoing description and fall within the scope of the appended claims.

What is claimed is:

1. A breast pad constructed and arranged to be used in a brassiere, the pad comprising:

a breast pad component comprising:

a foam layer including an outer surface, an inner surface and a plurality of openings that extends from the inner surface to the outer surface;

an inner cloth attached to at least a substantial portion of the inner surface of the foam layer;

a first outer cloth attached to at least a substantial portion of the outer surface of the foam layer;

a second outer cloth attached to at least a portion of the pad component and adjacent the first outer cloth; and wherein the foam layer comprises:

an upper portion having an upper thickness; and a lower portion having a lower thickness, wherein the upper thickness is less than the lower thickness in order to conform to the breast of the wearer.

2. The breast pad according to claim 1, wherein the foam layer comprises polyurethane.

3. The breast pad according to claim 1, wherein the foam layer is molded such that the inner surface is concave and the outer surface is convex.

4. The breast pad according to claim 1, wherein the foam layer comprises a thickness between approximately 1/16 inches and approximately 1/8 inches.

5. The breast pad according to claim 1, wherein the plurality of openings comprise a circular cross-section.

6. A breast pad according to claim 5, wherein the plurality of openings have a diameter between approximately 0.05 centimeters and approximately 0.5 centimeters.

7. A breast pad constructed and arranged to be used in a brassiere, the pad comprising:

a breast pad component comprising:

a foam layer including an outer surface, an inner surface and a plurality of openings that extends from the inner surface to the outer surface;

an inner cloth attached to at least a substantial portion of the inner surface of the foam layer;

a first outer cloth attached to at least a substantial portion of the outer surface of the foam layer;

a second outer cloth attached to at least a portion of the pad component and adjacent the first outer cloth; and wherein the plurality of openings comprise an inner cross-section proximate the inner surface of the foam layer and an outer cross-section proximate the outer surface of the foam layer, and wherein an area of the inner cross-section is smaller than an area of the outer cross-section.

8. The breast pad according to claim 1, wherein every square centimeter of the inner surface of the foam layer comprises at least a portion of at least one of the plurality of openings.

9. The breast pad according to claim 1, wherein each opening of the plurality of openings is spaced between approximately 0.25 centimeters and approximately 2.5 centimeters from at least one other opening.

10. The breast pad according to claim 9, wherein each opening is spaced approximately 1 centimeter from at least one other opening.

11. The breast pad according to claim 1, wherein the plurality of openings extend from an inner side of the inner cloth to an outer side of the first outer cloth.

12. The breast pad according to claim 1, wherein the plurality of openings comprise punched openings.

13. The breast pad according to claim 1, wherein the inner cloth comprises synthetic fabric.

14. The breast pad according to claim 13, wherein the inner cloth comprises polyester.

15. The breast pad according to claim 1, wherein the inner cloth is breathable.

16. The breast pad according to claim 1, wherein the inner cloth is wicking.

17. The breast pad according to claim 1, wherein at least a portion of the inner cloth is adhered to the foam layer.

18. The breast pad according to claim 17, wherein substantially the entire inner cloth is laminated to the foam layer.

19. The breast pad according to claim 17, wherein at least a portion of the inner cloth is glued to the foam layer.

20. The breast pad according to claim 1, wherein the inner cloth is constructed and arranged to be most proximate a wearer's breast.

21. The breast pad according to claim 1, wherein the first outer cloth comprises synthetic fabric.

22. The breast pad according to claim 21, wherein the first outer cloth comprises polyester.

23. The breast pad according to claim 1, wherein the first outer cloth is breathable.

24. The breast pad according to claim 1, wherein the first outer cloth is wicking.

25. The breast pad according to claim 1, wherein the first outer cloth and the inner cloth comprise the same material.

26. The breast pad according to claim 1, wherein at least a portion of the first outer cloth is adhered to the foam.

27. The breast pad according to claim 26, wherein substantially the entire first outer cloth is laminated to the foam.

28. The breast pad according to claim 26, wherein at least a portion of the first outer cloth is glued to the foam.

29. The breast pad according to claim 1, wherein the second outer cloth comprises synthetic fabric.

30. The breast pad according to claim 29, wherein the second outer cloth comprises polyester.

31. The breast pad according to claim 30, wherein the second outer cloth further comprises spandex.

32. The breast pad according to claim 31, wherein the second outer cloth further comprises approximately 84% polyester and approximately 16% spandex.

33. The breast pad according to claim 1, wherein the second outer cloth is breathable.

34. The breast pad according to claim 1, wherein the second outer cloth is wicking.

35. The breast pad according to claim 1, wherein the second outer cloth is attached to an outer edge area of the pad component.

36. The breast pad according to claim 1, wherein the second outer cloth is attached to at least a portion of the foam layer, at least a portion of the inner cloth and at least a portion of the first outer cloth.

37. The breast pad according to claim 36, wherein the second outer cloth is sewn to an outer edge area of the foam layer, an outer edge area of the inner cloth and an outer edge area of the first outer cloth.

38. The breast pad according to claim 1, wherein the second outer cloth is sewn to the at least a portion of the pad component.

39. A brassiere comprising:

a front portion;

a back portion; and at least one breast pad of claim 1, positioned on the interior of the front portion.

40. The brassiere according to claim 39, further comprising a second pad wherein the breast pad is constructed and arranged to cover a wearer's first breast area and the second pad is constructed and arranged to cover a wearer's second breast area.

41. A brassiere comprising:

a front portion;

a back portion; and a breast pad positioned on the interior of the front portion, the pad comprising:

a pad component comprising:

a foam layer including an outer surface, an inner surface and a plurality of openings that extends from the inner surface to the outer surface;

an inner cloth attached to at least a substantial portion of the inner surface of the foam layer;

a first outer cloth attached to at least a substantial portion of the outer surface of the foam layer;

a second outer cloth attached to at least a portion of the pad component and adjacent the first outer cloth;

an outer layer constructed and arranged to lie most distal a wearer's skin, wherein the second outer cloth of the breast pad is covered by the outer layer of the brassiere.

42. The brassiere according to claim 41, further comprising an inner layer constructed and arranged to be attached to at least a portion of the outer layer, wherein the inner layer of the brassiere and the inner cloth of the pad form at least a portion of an inner surface of the brassiere, the inner surface of the brassiere being constructed and arranged to lie most proximate the wearer's skin.

43. The brassiere according to claim 42, wherein the inner layer comprises a wicking material.

44. The brassiere according to claim 43, wherein the wicking material comprises at least 1% elastic fibers and wicking fibers and wherein the wicking material is constructed and arranged to move water at least 15 centimeters in at least one direction along the wicking material in approximately 30 minutes.

45. The brassiere according to claim 42, further comprising an elastic band attached to the inner layer of the brassiere, wherein the elastic band is constructed and arranged to lie below the breasts of the wearer.

46. The brassiere according to claim 39, wherein the brassiere is a sports bra.

47. A brassiere for covering at least a portion of the breasts of a wearer, the brassiere including a front portion and a back portion configured to extend around the chest of a wearer, wherein a cross-section of at least a portion of the brassiere comprises:

a first layer comprising an inner cloth, the inner cloth being constructed and arranged to contact at least a portion of the breasts of the wearer;

a second layer constructed and arranged to lie more distal the wearer than the first layer, the second layer comprising a layer of foam including an outer surface, an inner surface and a plurality of openings that extend from the inner surface to the outer surface;

a third layer constructed and arranged to lie more distal the wearer than the second layer, the third layer comprising a first outer cloth;

a fourth layer constructed and arranged to lie more distal the wearer than the third layer, the fourth layer comprising a second outer cloth; and a fifth layer constructed and arranged to lie more distal the wearer than the fourth layer, the fifth layer comprising an outer layer.

48. The brassiere according to claim 47, wherein the cross-section comprises a breast cross-section of a portion of the brassiere that is constructed and arranged to cover the wearer's breasts.

49. The brassiere according to claim 47, wherein at least one of the second and/or third layers comprises a non-white coloring and wherein the fourth layer is constructed and arranged to obscure the non-white coloring from view when the brassiere is viewed from an outer surface of the fifth layer.

50. The brassiere according to claim 47, wherein the inner cloth is attached to at least a substantial portion of the inner surface of the foam layer.

51. The brassiere according to claim 47, wherein the first outer cloth is attached to at least a substantial portion of the outer surface of the foam layer.

52. The brassiere according to claim 47, wherein the foam layer comprises polyurethane.

53. The brassiere according to claim 47, wherein the foam layer is molded such that the inner surface is concave and the outer surface is convex.

54. The brassiere according to claim 47, wherein the foam layer comprises a thickness between approximately 1/16 inches and approximately 1/8 inches.

55. The brassiere according to claim 47, wherein the foam layer comprises:

an upper portion having an upper thickness; and a lower portion having a lower thickness, wherein the upper thickness is less than the lower thickness.

56. The brassiere according to claim 47, wherein the plurality of openings comprise a circular cross-section.

57. The brassiere according to claim 56, wherein the plurality of openings have a diameter between approximately 0.05 centimeters and approximately 0.5 centimeters.

58. The brassiere according to claim 47, wherein the plurality of openings comprise an inner cross-section proximate the inner surface of the foam layer and an outer cross-section proximate the outer surface of the foam layer, and wherein an area of the inner cross-section is smaller than an area of the outer cross-section.

59. The brassiere according to claim 47, wherein every square centimeter of the inner surface of the foam layer comprises at least a portion of at least one of the plurality of openings.

60. The brassiere according to claim 47, wherein each opening of the plurality of openings is spaced between approximately 0.25 centimeters and approximately 2.5 centimeters from at least one other opening.

61. The brassiere according to claim 60, wherein each opening is spaced approximately 1 centimeter from at least one other opening.

62. The brassiere according to claim 47, wherein the plurality of openings extend from an inner side of the inner cloth to an outer side of the first outer cloth.

63. The brassiere according to claim 47, wherein the plurality of openings comprise punched openings.

64. The brassiere according to claim 47, wherein the inner cloth comprises synthetic fabric.

65. The brassiere according to claim 64, wherein the inner cloth comprises polyester.

66. The brassiere according to claim 47, wherein the inner cloth is breathable.

67. The brassiere according to claim 47, wherein the inner cloth is wicking.

68. The brassiere according to claim 47, wherein at least a portion of the inner cloth is adhered to the foam layer.

69. The brassiere according to claim 68, wherein substantially the entire inner cloth is laminated to the foam layer.

70. The brassiere according to claim 68, wherein at least a portion of the inner cloth is glued to the foam layer.

71. The brassiere according to claim 47, wherein the first outer cloth comprises synthetic fabric.

72. The brassiere according to claim 71, wherein the first outer cloth comprises polyester.

73. The brassiere according to claim 47, wherein the first outer cloth is breathable.

74. The brassiere according to claim 47, wherein the first outer cloth is wicking.

75. The brassiere according to claim 47, wherein the first outer cloth and the inner cloth comprise the same material.

76. The brassiere according to claim 47, wherein at least a portion of the first outer cloth is adhered to the foam.

77. The brassiere according to claim 76, wherein substantially the entire first outer cloth is laminated to the foam.

78. The brassiere according to claim 76, wherein at least a portion of the first outer cloth is glued to the foam.

79. The brassiere according to claim 47, wherein the second outer cloth comprises synthetic fabric.

80. The brassiere according to claim 79, wherein the second outer cloth comprises polyester.

81. The brassiere according to claim 80, wherein the second outer cloth further comprises spandex.

82. The brassiere according to claim 81, wherein the second outer cloth further comprises approximately 84% polyester and approximately 16% spandex.

83. The brassiere according to claim 47, wherein the second outer cloth is breathable.

84. The brassiere according to claim 47, wherein the second outer cloth is wicking.

85. The brassiere according to claim 47, wherein the second outer cloth is attached to an outer edge area of the pad component.

86. The brassiere according to claim 47, wherein the second outer cloth is attached to at least a portion of the foam layer, at least a portion of the inner cloth and at least a portion of the first outer cloth.

87. The brassiere according to claim 86, wherein the second outer cloth is sewn to an outer edge area of the foam layer, an outer edge area of the inner cloth and an outer edge area of the first outer cloth.

88. The brassiere according to claim 47, wherein the second outer cloth is sewn to the at least a portion of the pad component.

89. The brassiere according to claim 47, wherein the first layer further comprises a wicking material.

90. The brassiere according to claim 89, wherein the wicking material comprises at least 1% elastic fibers and wicking fibers and wherein the wicking material is constructed and arranged to move water at least 15 centimeters in at least one direction along the wicking material in approximately 30 minutes.

91. The brassiere according to claim 47, further comprising an elastic band attached to the first layer, wherein the elastic band is constructed and arranged to lie below the breasts of the wearer.

92. The brassiere according to claim 47, wherein the brassiere is a sports bra.

93. A breast pad component constructed and arranged to be used in a brassiere, the breast pad component comprising:

a layer of foam including an outer surface, an inner surface and a plurality of openings that extend from the inner surface to the outer surface, the plurality of openings comprising at least a first and a second cross-sections;

an inner cloth constructed and arranged to be attached to at least a portion of the inner surface; and a first outer cloth constructed and arranged to be attached to at least a portion of the outer surface;

wherein the first cross-section is different than the second cross-section.

94. The breast pad component according to claim 93, wherein the first cross-section is at the inner surface of the foam and the second cross-section is at the outer surface of the foam and wherein the inner cross-section is smaller than the outer cross-section.

95. The breast pad component according to claim 93, wherein the breast pad component is formed by the method comprising:

creating the plurality of openings in the foam; and molding the foam such that the inner surface is concave and the outer surface is convex.

96. The breast pad component according to claim 95, wherein creating the plurality of openings in the foam comprises creating the plurality of openings with a substantially constant cross-section.

97. The breast pad component according to claim 96, wherein the first cross-section is at the inner surface of the foam and the second cross-section is at the outer surface of the foam and wherein molding the foam further comprises making the inner cross-section smaller than the outer cross-section.

* * * * *